US005848945A

United States Patent [19]

Miller et al.

[11] Patent Number: 5,848,945

[45] Date of Patent: Dec. 15, 1998

[54] POWERED MOVEABLE BATTING TEE

[76] Inventors: Joseph M. Miller, 9109 Volunteer Dr.; Dillon Lee, 8126 Keeler St.; Michael C. Porter, 8110 Orville St., all of Alexandria, Va. 22309

[21] Appl. No.: 2,377

[22] Filed: Jan. 2, 1998

Related U.S. Application Data

[60] Provisional application No. 60/034,605, Jan. 3, 1997.

[51] Int. Cl.[6] ..... A63B 69/40

[52] U.S. Cl. ..... 473/417

[58] Field of Search ..... 473/417, 422, 473/451, 103

[56] References Cited

U.S. PATENT DOCUMENTS

| | | |
|---|---|---|
| 3,489,411 | 1/1970 | Morelli et al. . |
| 4,575,080 | 3/1986 | Miles . |
| 4,989,866 | 2/1991 | Dill . |
| 4,993,708 | 2/1991 | Prosser et al. . |
| 5,004,234 | 4/1991 | Hollis . |
| 5,076,580 | 12/1991 | Lang . |
| 5,386,987 | 2/1995 | Rodino, Jr. . |
| 5,388,823 | 2/1995 | Prieto . |
| 5,393,050 | 2/1995 | Lloyd . |
| 5,478,070 | 12/1995 | Morrison . |
| 5,662,536 | 9/1997 | Martinez . |

OTHER PUBLICATIONS

How to Make a Batting Tee (1 page); "TeeBall" (1 page).

*Primary Examiner*—Raleigh W. Chiu
*Attorney, Agent, or Firm*—Richard C. Litman

[57] ABSTRACT

The powered, movable hitting tee made up of a vertical tee, a reciprocating, horizontally-disposed rod supporting the vertical tee, a movable sled or carriage assembly within which the reciprocating rod is mounted, a drive belt or, in the alternative, a chain and sprocket assembly arranged parallel to and in operable contact with the rod, thus engaging the rod and driving the same, a motor for rotating the drive belt or chain, thus to move the sled, rod and vertical tee, and a box enclosure for all the components of the invention, save for a portion of the reciprocating rod and the vertical tee. The rod free-end and the base of the vertical tee are, in a first embodiment, only loosely, frictionally interfitted together so that, should the vertical tee be accidentally struck, then it will simply fall off of the rod, without damage to any of the parts of the invention. The vertical tee may include a rather rigid lower segment and a somewhat flexible upper segment made of memory-retentive material (e.g., rubber), which will bend but not be damaged when struck accidentally by a bat. The upper end of vertical tee upper segment may be flared to support a baseball or softball. In a second embodiment, the tee support includes a coil spring as a shock absorber for misaimed hitting. A removable motor assembly and remote control devices may also be included.

20 Claims, 6 Drawing Sheets

POWERED MOVEABLE BATTING TEE

CROSS-REFERENCE TO RELATED APPLICATION

This application claims the benefit of U.S. Provisional Patent Application Serial No. 60/034,605, filed Jan. 3, 1997.

BACKGROUND OF THE INVENTION

1. Field of the Invention

The present invention relates generally to baseball or softball training devices in the form of hitting tees and, more specifically, to a portable, powered, moving hitting tee which helps to train a novice hitter, especially, to keep his or her eye "on the ball." The invention has particular use in training youngsters to hit the ball with a bat while the ball moves toward them, slowly, so that hand-eye coordination may be developed. Of course, the invention has utility during any regular hitting practice as well.

2. Description of the Prior Art

The prior art is replete with examples of hitting tees, but none which move in the manner of the instant invention and are powered to move in a preplanned manner. Rather, the prior art only discloses batting tees wherein the position of the ball to be struck by a bat may be adjustable to a number of positions. With one somewhat relevant exception, there are no teachings in the art of a batting tee wherein the ball while supported by the tee is actually moved by the batting tee into a strike zone just before it is struck, this being the essence of the present invention.

The exception just noted appears in U.S. Pat. No. 4,575,080, issued Mar. 11, 1986 to Michael E. Miles. This patent teaches a batting tee assembly including a blower creating an air stream for suspension of a baseball. The baseball may be oscillated vertically and/or moved in a circular fashion by the tee which also includes angled outlets below the top of the tee, for rotating the tee and thus the ball as it remains air-suspended. Thus, the machine provides simulation of the rising, falling and curving motions of a baseball as it approaches the batter. This patent does not teach, however, tee-supported movement of the baseball into the strike zone, the ball remaining in contact with and supported by the tee as it moves toward the batter. Furthermore, a blower assembly, with its attendant noise distraction and power requirement characteristics, is not needed in the present invention.

Batting tees for supporting a ball in a stationary position are well known. A publication entitled "How to Make a Batting Tee" teaches one to secure a length of radiator hose over a section of water pipe, and insert the pipe into a plywood base shaped as a home plate. The device may be sand-weighted for stability and the home plate my be drilled at numerous location for insertion of the pipe segment, at various places on the home plate, to simulate a number of ball locations, all in the strike zone. The baseball is positioned on top of the radiator hose segment. Again, the basic batting tee including a vertical post, an upper, flexible ball support, and a weighted base which may be configured as a home plate is well known. A toy-like version of a batting tee called "TeeBall" complete with metal tee, and plastic ball and bat, has been marketed in the past.

U.S. Pat. No. 5,388,823 issued Feb. 14, 1995, to Ronald G. Prieto is representative of a number of prior art teachings of batting tees, wherein adjustable positioning of a stationary baseball for batting practice is provided. A similar, variable positioning batting tee for supporting a baseball in a stationary attitude for batting practice is seen in U.S. Pat. No. 3,489,411 issued Jan. 13, 1970, to Dominick J. Morelli, et al. While the batting tees taught by these two patents have mechanisms for x, y and z axis adjustment of a seat for the baseball to be struck, there is no teaching of actually moving the baseball while on the tee, toward the batter, just prior to striking the ball.

Additional variations on the theme of a batting tee for adjustable but static position of a baseball are taught in U.S. Pat. Nos.: 4,989,866, issued Feb. 5, 1991 to David N. Dill; 5,004,234 issued Apr. 2, 1991, to Ray A. Hollis; 5,076,580 issued Dec. 31, 1991, to Johnny D. Lang; 5,662,536 issued Sep. 2, 1997 to Rodolfo Martinez; and 5,393,050 issued Feb. 28, 1995, to Anthony L. Lloyd (see FIG. 7). A batting tee with guide arms to direct the bat toward the supported ball is seen in U.S. Pat. No. 5,478,070 issued Dec. 26, 1995, to Howard J. Morrison, and a ball tethered to the batting tee is taught in U.S. Pat. No. 5,386,987 issued Feb. 7, 1995, to John P. Rodino, Jr. A particular flexible support for the upper portion of a batting tee, for retaining parts together without damage to the device should it be struck during a practice swing, is taught in U.S. Pat. No. 4,993,708, issued Feb. 19, 1991, to William Prosser, et al.

The prior art does not teach the present invention which is, simply stated, an uncomplicated, powered, movable batting tee which approaches the batter at a predetermined but rather deliberate, speed, the ball remaining on the tee as the tee enters a preplanned strike zone, where the batter then takes a swing at the tee-supported ball, with his or her bat.

None of the above inventions and patents, taken either singly or in combination, is seen to describe the instant invention as claimed.

SUMMARY OF THE INVENTION

The powered, movable hitting tee of the instant invention is made up of a vertical tee, a reciprocating, horizontally-disposed rod supporting the vertical tee, a movable sled or carriage assembly within which the reciprocating rod is mounted, a drive system arranged parallel to and in contact with the rod, thus frictionally engaging the rod and driving the same, a motor and pulley assembly for rotating the drive belt, thus to move the sled, rod and vertical tee, and a box enclosure for all the components of the invention, save for a portion of the reciprocating rod which projects from one end of the box enclosure, and the vertical tee, which is mounted on the free, outer end of the reciprocating rod.

Multiple embodiments are described having the above noted common elements. In one embodiment, the rod free-end and the base of the vertical tee may be loosely frictionally interfitted together so that, should the vertical tee be accidentally struck by the hitter (this will happen often, especially when youngsters are using the invention), then it will simply fall off of the rod, without damage to any of the parts of the invention. The first embodiment may include a rather rigid lower segment and a somewhat flexible upper segment made of memory-retentive material (e.g., rubber), which will bend but not be damaged when struck accidentally by a bat. In the preferred and alternate embodiment, a coil spring is interposed between the free-end of the rod of the base to effect the same purposes and functions, thus allowing each of the components to be threadedly attached to one another and be provided with added height adjustment features. The upper end of vertical tee upper segment may be flared to support a baseball or softball. Finally, the preferred embodiment may be remotely operated by a remote control handset and receiving unit attached to the motorized drive system.

Accordingly, it is a principal object of the invention to provide a powered, movable hitting tee which supports a ball to be hit and moves the ball toward a preplanned strike zone, the ball remaining on the tee during movement of the tee.

It is another object of the invention to provide a powered, movable hitting tee, supported and powered to move toward a hitter at a fixed or variable speed, there further being a provision for differing fixed or variable speeds.

It is a further object of the invention to provide a powered, movable hitting tee which movement may be remotely controlled by a handset.

Still another object of the invention is to provide a powered, movable hitting tee including a horizontally movable and powered sled or carriage assembly located within a box enclosure, with the movable tee extended beyond the box to a first position, farthest from the box, and then movable toward the box, there being an imaginary strike zone defined just beyond one end of the box.

It is still an additional object of the invention to provide a powered, movable hitting tee which is designed and configured to move a tee-mounted ball toward a hitter and a strike zone, the speed of movement being variable for different player skill levels, the invention being particularly useful in training youngsters to keep an eye on the ball as the ball approaches a strike zone.

It is an object of the invention to provide a powered, movable hitting tee which may be remotely controlled by electrical signal, with or without an acoustic actuator activated by voice command, the motor for moving the tee being battery-powered or house-current powered, there being a friction-drive belt and rod or chain and sprocket arrangement for powering the movable hitting tee.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a movable, powered hitting tee intended for training youngsters or other athletes in the fine art of accurately striking a ball with a striking implement, such as a bat, racket or even one's hand, described by some as one of the most difficult endeavors in all of sports. A key discipline in learning the skill of striking a round ball with a round bat is to keep an eye on the ball as the ball is hurled into the imaginary strike zone over home plate, next to the batter.

Prior art batting tee devices are, in the main, simply stationary devices and cannot assist in the training of the baseball novice in keeping his or her eye on the moving ball. The exception noted above of an air-stream supported ball, although useful in providing ball movement emulating a curve ball, a sinker and other pitching movements, nevertheless does not provide for the guided movement of a tee supported ball into the strike zone, which movement may be done at a rather slow speed, if desired, to help train the batter in the fine art of keeping an eye on the ball.

Figure 1:
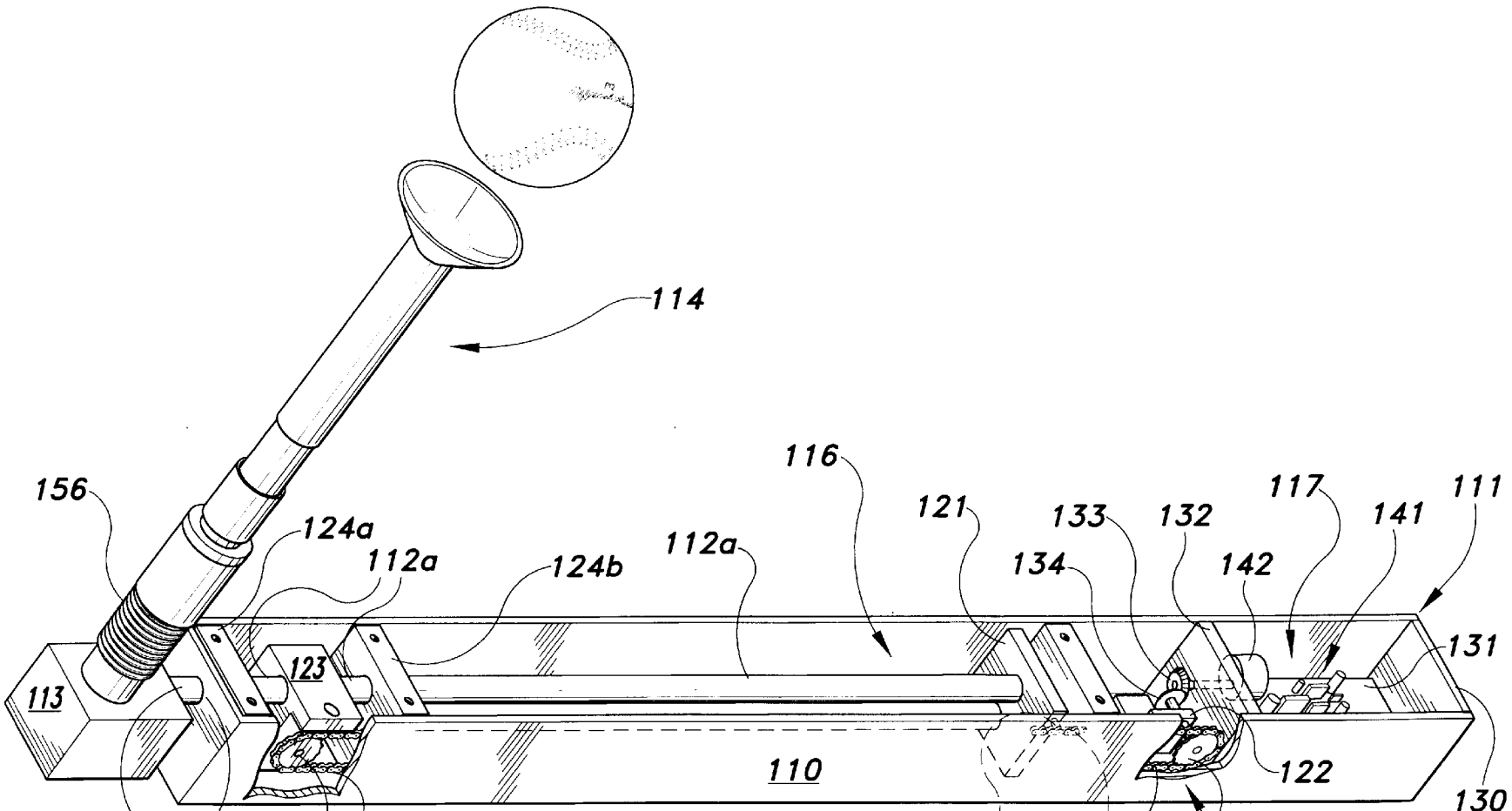
FIG. 1 is a perspective view of a preferred embodiment of the invention, parts being broken away to reveal interior detail, the hitting tee being fully retracted to a position within an imaginary strike zone.
Figure 7:
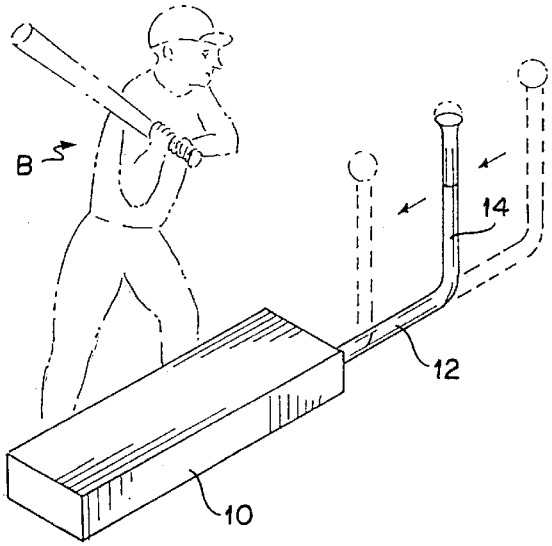
FIG. 7 is a largely diagrammatic, environmental perspective view of the alternative embodiment showing movement of the powered hitting tee toward a hitter.
Figure 6:
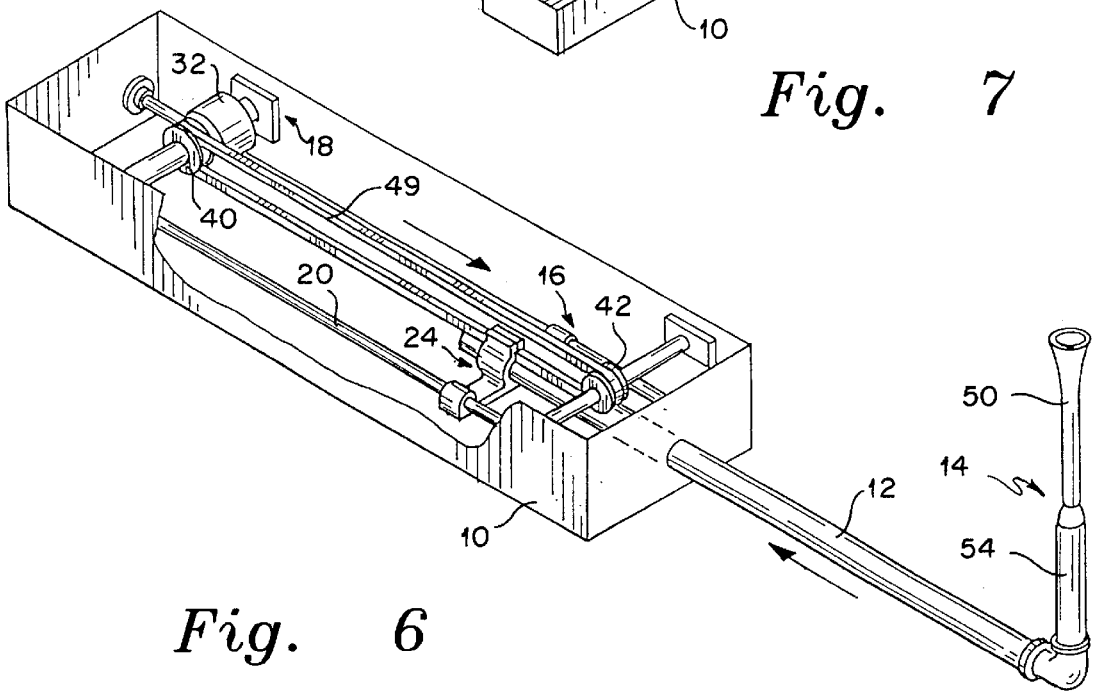
FIG. 6 is a view of the alternative embodiment similar to FIG. 5, but drawn to a reduced scale and depicting the hitting tee in a position fully extended from the box housing the power components for the movable hitting tee.

With reference now to the several drawings by reference character to describe the common functional features of the present invention, FIG. 7 will be described first, followed by the two different embodiments of the powered movable hitting tees as primarily shown in FIGS. 1 and 5. With particular reference to FIG. 7, there is shown a batter B who is practicing batting with the aid of the instant invention, the batter being right-handed in this particular illustration. It should be noted here that the batter may be left-handed and no modification of the invention whatsoever is required for accommodating left-handed batters. In any event, there is provided a box enclosure 10 from which extends a horizontally disposed drive and support rod 12, which has the movable hitting tee 14 part of the invention mounted to extend vertical therefrom as shown. Components internal to the box 10 are arranged and configured first, to extend the movable tee 14 to a point of maximum separation from the box 10, indicated by dashed lines at the right hand side of FIG. 8, and second, then to move the tee 14 toward the batter B's strike zone, as indicated at the immediate right-hand side of the box 10. (The strike zone itself is not illustrated in order to enhance the clarity of the rest of the view.)

Figure 5:
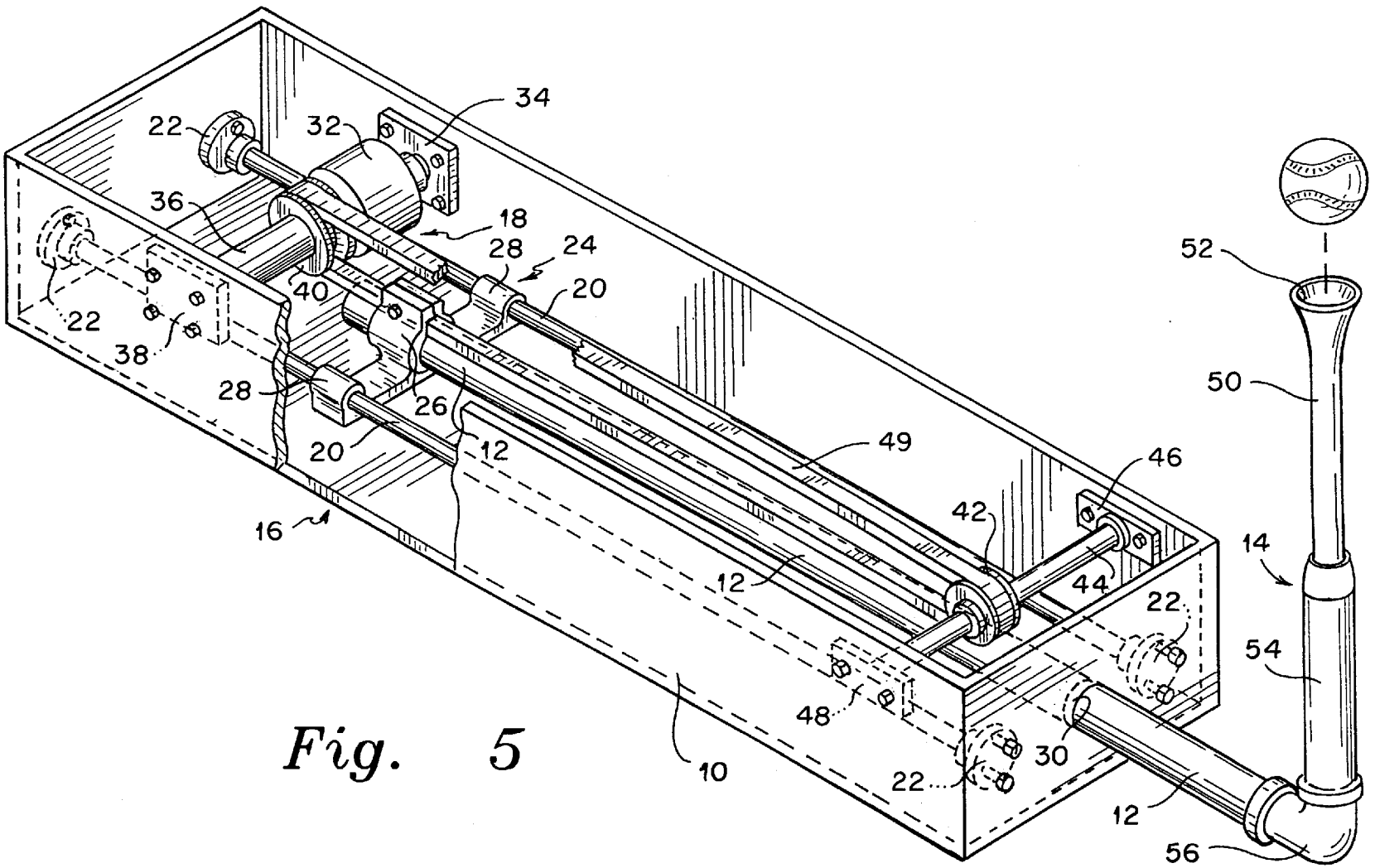
FIG. 5 is a perspective view of an alternative embodiment of the invention, parts being broken away to reveal interior detail, the hitting tee being fully retracted to a position within an imaginary strike zone.

Turning now to FIG. 5 showing the alternative embodiment, the box enclosure 10 houses the two main support and drive components of the invention, these including a reciprocating sled or carriage assembly 16 and a drive motor, pulley and belt subassembly 18.

Sled assembly 16 is made up of a pair of fixed, stationary slide rails or rods 20, 20, which are mounted to the respective end walls of box 10 by suitable brackets 22, and a slide 24 which is fixed to the interior end of drive rod 12 at 26, slide 24 including outrigger guides 28, 28, encircling respective rods 20, 20 and slidable therealong. Guides 28, 28 may include interior antifriction pads or bearings (not shown) made of PTFE or the like; alternatively, the rails and/or guides may be lubricated. Support for the outer end of drive rod 12 is provided at opening 30 defined through an end wall of box 10. The opening may also be provided with suitable antifriction pads, bearings or lubrication. In any event, it is clearly appreciated that the drive and support rod 12 is supported for controlled, reciprocating movement back and forth with respect to the box 10 by the assembly 16.

Drive motor, pulley and belt subassembly 18 includes an uncomplicated electric motor 32 (AC or DC type, 110 volt or, preferably, battery powered) mounted to a side wall of box 10 by a bracket 34, and including an output or drive shaft 36 which, in turn, has an outer end rotatably received in a suitable bracket 38. A drive pulley 40 is affixed to shaft 36. Oppositely disposed in box 10 is a slave pulley 42 mounted for rotation on an idler shaft 44 fixed in blocks 46, 48 to the opposed interior walls of box 10, as shown. (Alternatively, of course, slave pulley 42 may be fixed to shaft 44 and the opposed ends of shaft 44 may be mounted in blocks 46, 48, which would be bearing blocks, on opposed interior walls of box 10.) Interconnecting the two pulleys is an endless drive belt 49 which is clamped to slide 24 at 26.

The operation of the invention is now readily appreciated. Operation of motor 32 causes rod 12 to be fully extended and move the hitting tee 14 to the first position above explained, and reverse operation of motor 32 causes rod 12 to be drawn into box 10, thus moving the hitting tee to the second position, again fully explained above. Movement of the rod 12 into box 10 is appreciated from an inspection of FIG. 2.

While a drive belt and pulley arrangement for movement of rod 12 has been disclosed, other drives could be employed, e.g., a chain and sprocket drive, without departing from the scope of the invention. Such an arrangement is shown in the preferred embodiment of FIG. 1 and FIG. 2. There too is provided a box enclosure 110 from which extend a pair of horizontally disposed drive and support rods, 112*a* and 112*b* (partially hidden in places), terminating in a mounting block 113 having a bore into which a movable hitting tee assembly 114 of the invention is mounted to extend vertical therefrom, as shown.

Figure 2:
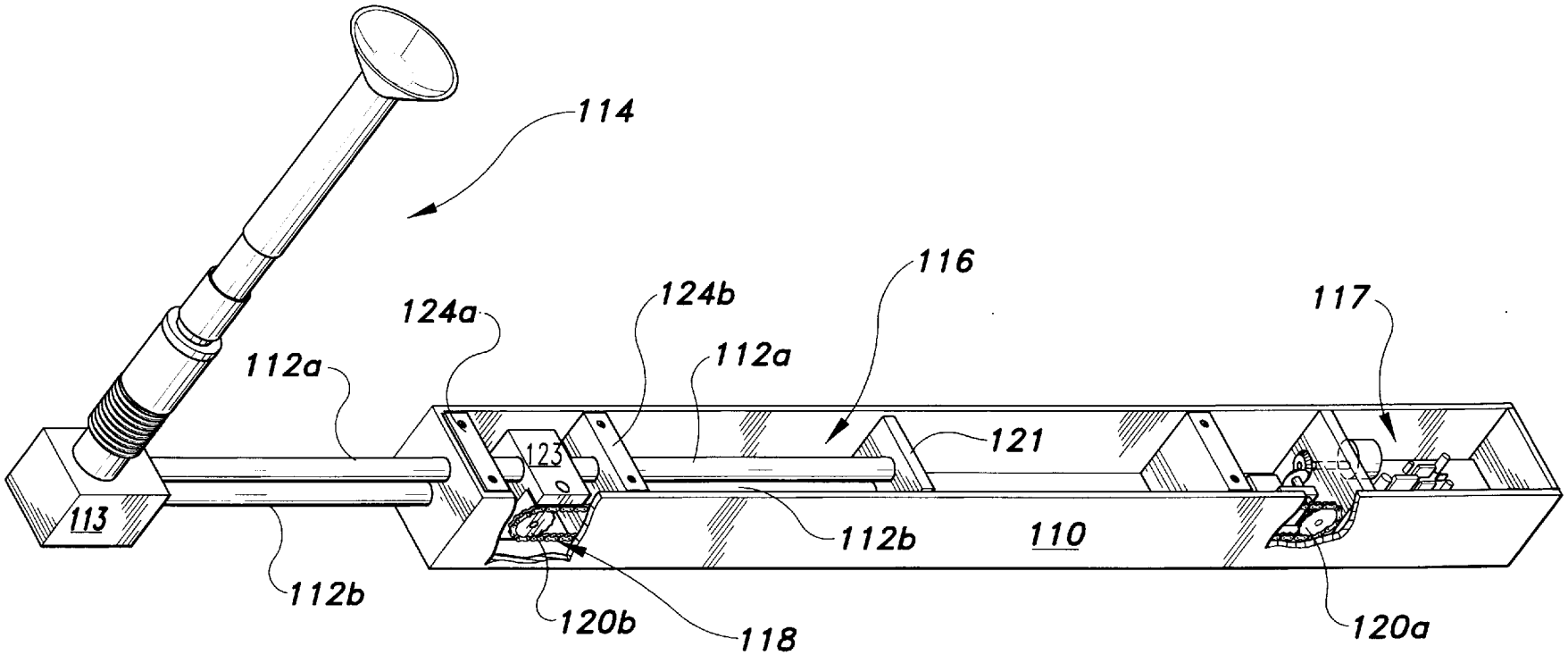
FIG. 2 is a view similar to FIG. 1, but drawn to a reduced scale and depicting the hitting tee in a position partially extended from the box housing the power components for the movable hitting tee.

Components internal to the box 110 are arranged and configured first, to extend the movable tee assembly 114 to any position of separation from the box 110 within a range defined by the length of the rods 112*a*, 112*b*, one such position of partial extension shown by FIG. 2. A fully retracted position is shown in FIG. 1, which, when the box 110 is positioned proximate a hitter, causes the tee assembly 114 to be moved toward the batter B's strike zone.

Like the alternate embodiment, the box 110 of the preferred embodiment houses the two main support and drive components of the invention, these including a reciprocating sled 116 and a drive motor assembly 117 at a first end 111 of box 110. However and first, the motor assembly 117 is removably installed by means of separate removable housing plate 131 including an end wall 130 of box 110 and a support wall 132 to which the motor is mounted. The motor drives a shaft passing through support wall 132 and terminates in a bevel gear 133.

Next, unlike the alternate embodiment having a pulley and belt subassembly 18 which is stationary and drives the carriage 16 along a pair of support rods 20, the sled assembly 116 is made up of the pair of rods 112*a*, 112*b*, which are mounted to a drive plate 121 at a first end interior box 110 and further mounted to mounting block 113 at the free ends exterior box 110. The rods 112*a*, 112*b* pass through a plurality of bores in support blocks 124*a* and 124*b*, fixed to box 110 distal from first end 111. A chain and sprocket drive 118 is provided which drives the sled 116 in a reciprocating fashion by virtue of the chain's ability to reverse the direction of travel through a linkage with a second bevel gear 134 in turn intermeshing with bevel gear 133 of the motor assembly 117.

The chain 119 revolves in a loop about a pair of slave sprockets 120*a* and 120*b*, which are rotatably attached to a stationary pair of blocks 122 and 123 attached to box 110, the chain 119 in turn affixed by a fastener 125 to drive plate 121. Block 123 includes a pair of bores through which rods 112*a*,112*b* of the sled 116 also pass. Each of the blocks 123, and 124*a* and 124*b* may include interior antifriction pads or bearings (not shown) made of PTFE, nylon or the like; alternatively, the rods and/or bores may be lubricated. Further support for the outer end of drive rods 112*a*,112*b* of sled 116 is also provided at opening 130 defined through an end wall of box 110. The opening may also be provided with suitable antifriction pads, bearings or lubrication.

Thus, the drive and support rods 112*a*, 112*b* of sled 116 are supported for controlled, reciprocating movement back and forth with respect to the box 110. As the chain and sprocket assembly 118 is driven by the linkage between bevel gears 133,134 of the removable motor assembly 117 and chain and sprocket assembly 118, the sled 116 correspondingly moves forward or reverse by virtue of its attachment to the chain 119 at drive plate 121.

Figure 3:
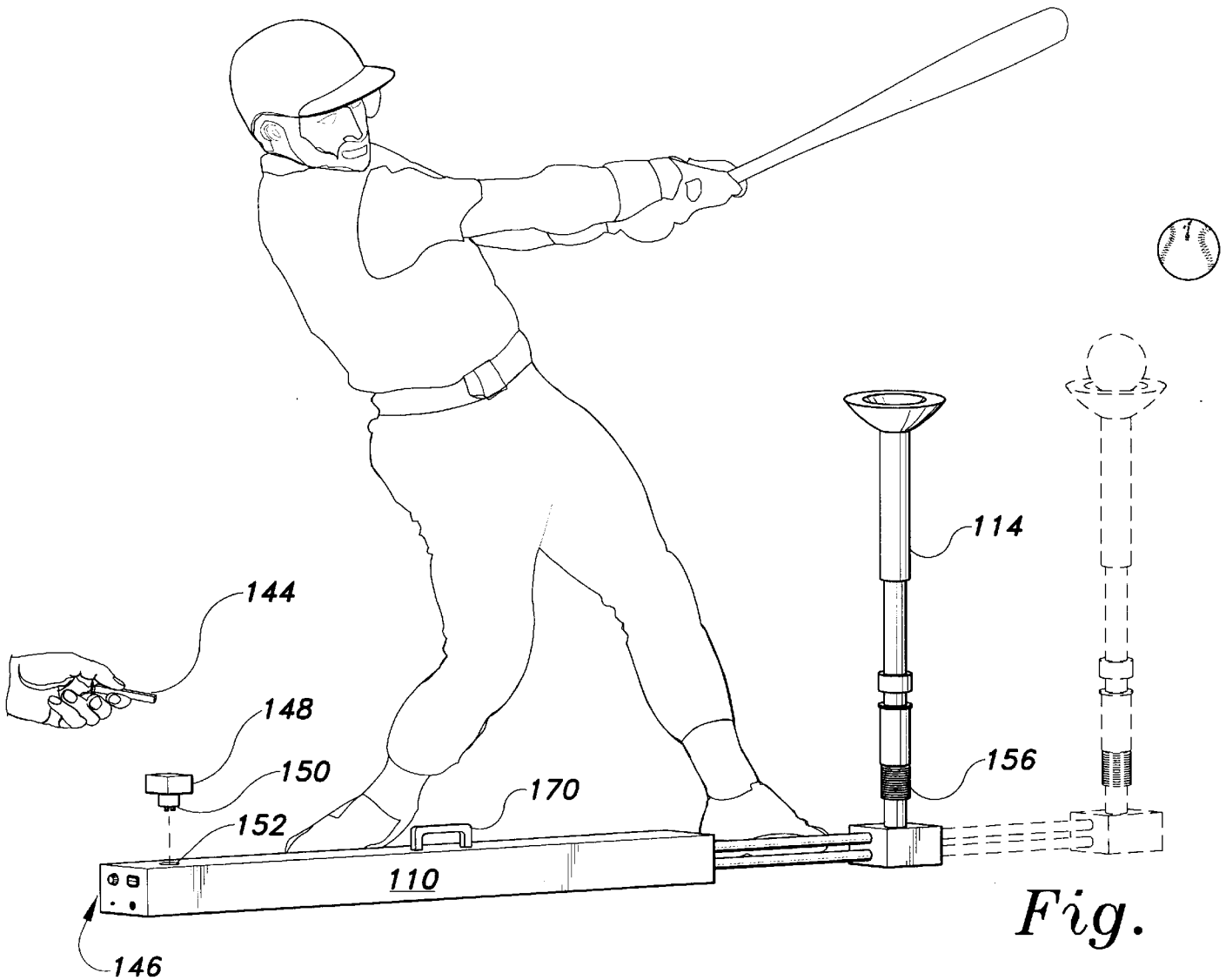
FIG. 3 is a largely diagrammatic, environmental perspective view showing movement of the powered hitting tee toward a hitter as controlled by a remote means.

The drive motor assembly 117 includes an electric motor 142 and circuit board 141 which permits either direct or remote controlled operation of the unit. As shown in FIG. 3, a remote controlled handset 144 is supplied for sending appropriate infrared or RF signals to activate a corresponding receiver in communication with the circuitry of the motor assembly 117. A pushbutton remote handset 144 having on or off and forward or reverse switches may be provided. Switches 146 are also provided exposed to the exterior of end wall 130, which switches 146 perform similar activation features but are in direct contact with the circuitry.

As an added convenience, an externally mounted, removable and rechargeable battery 148 is provided, which is dimensioned and configured to include a contact terminal portion 150 which passes through an opening 152 provided in a wall of the box 110 and subsequently seats onto a contact terminal of the motor assembly 117. Thus, the motor assembly 117 may be energized with a portable power source, and, when power runs low, the assembly 117 may receive a replacement battery allowing the first battery to be recharged. This arrangement obviates the need for tools to remove the battery 148 from the box 110, and simple manual removal of the battery 148 is sufficient. This permits transportation of the unit to non-electrified sports fields and, with multiple batteries, permits the continuous use of the invention. This feature further eliminates the need for potentially hazardous electrical cords, which may interfere with play.

Focusing now on the hitting tees of the two embodiments, hitting tee 14 of the alternate embodiment is made up of an upper segment 50, outwardly flared at its upper end 52 to receive a baseball or softball, and made of suitable memory-retentive material so as to return to its original configuration after being struck by a misaimed bat, an expected, regular occurrence. Segment 50 is seated in base segment 54 which is joined by elbow 56 to drive rod 12. In an alternative embodiment, the junction of elbow 56 with rod 12 is a friction-fit only, so that when a bat unintendedly strikes tee 14, the whole tee simply falls of rod 12 and the operative components of the invention will not be damaged. As alternatives, segment 50 might be friction-fit into base 54, and/or segment 54 may be friction-fit into elbow 56. Various combinations of friction-fit assemblage are envisioned, and the scale of hitting tee components illustrated may be varied or parts deleted. For example, segment 50 could be much longer or shorter than shown, or extend down into elbow 56, base segment 54 thus being eliminated.

Figure 4:
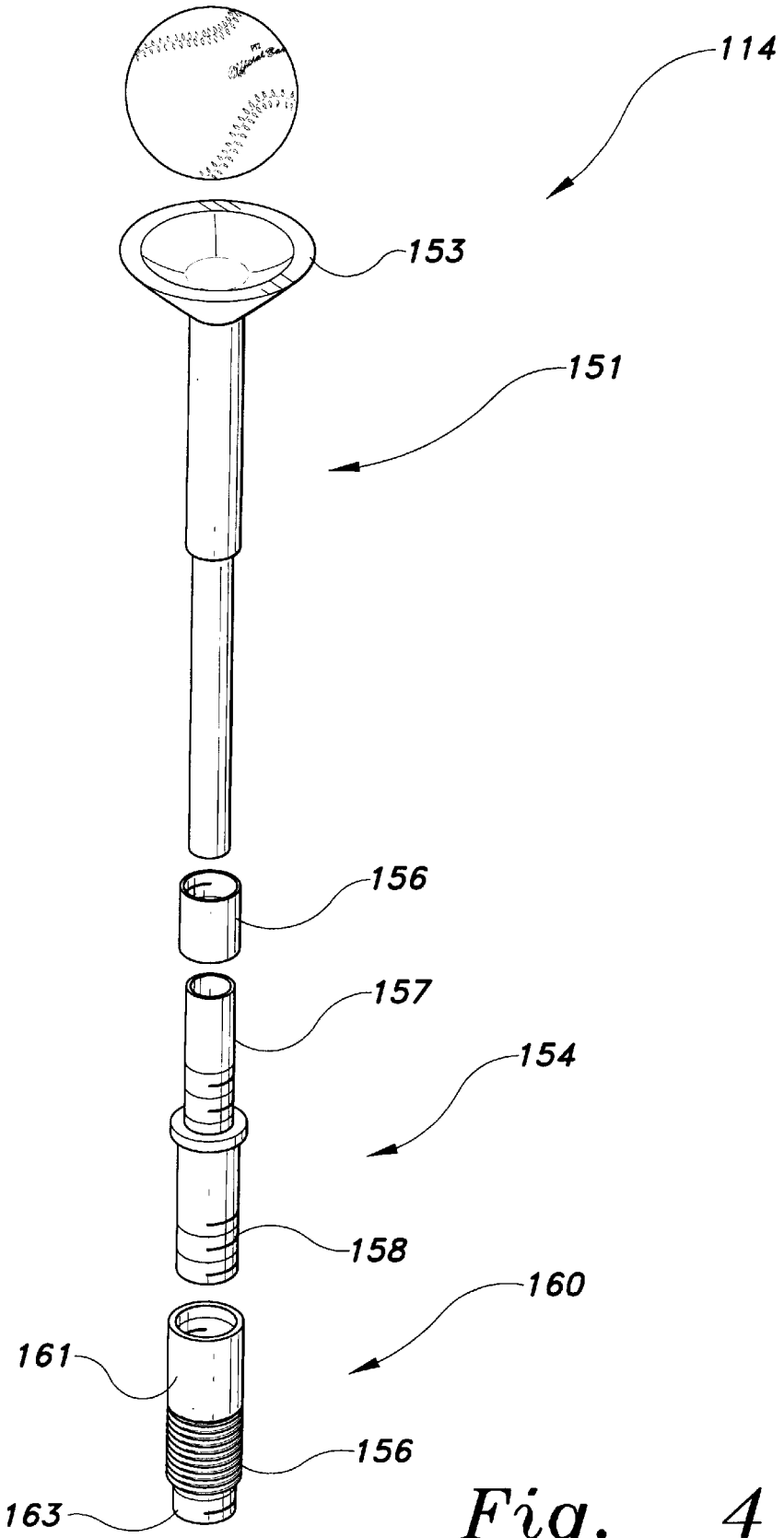
FIG. 4 is an exploded view of the tee component showing its interchangeable components.

As shown in the preferred embodiment, best seen in FIG. 4 in exploded view, the hitting tee 114 comprises an upper segment 151, outwardly flared at its upper end 153 to receive a ball, which flared portion may be resilient material such as rubber or plastic. Tubular rigid material, such as aluminum or other shock resistant material, may be used to construct the remainder of the upper segment 151, the materials chosen to eliminate damage thereto after being struck by a misaimed bat or other implement. Segment 151 is slidably disposed in middle segment 154 at a top end 157, which is a tubular member dimensioned and configured to receive the upper segment 151. The top end 157 includes a threaded locking collar 156, well known in the art of tubular length adjustment means, for tightening around the upper segment 151 while it is seated at a predetermined height relative to the middle segment 154. This permits height adjustment of the tee for varying height users. The middle segment 154 is in turn provided with an opposing threaded end 158 which screws into a base segment 160 which is also tubular and dimensioned and configured at its upper end 161 to receive the threaded end 158 of the middle segment 154. Additional segments (not shown) similarly threaded and uniformly sized consistent with the dimensions of the receiving ends of associated segments may be added to further extend the height of the tee portion 114 as desired.

To dampen the shock of misaimed bat strikes against the upper segment 151, the base segment 160 includes a coil spring 156 disposed between the upper end 161 and a base end 163. The base end 163 is in turn provided with a thread which screws into a matingly threaded bore of the mounting block 113 (shown in FIG. 1). The base segment 160 provides an oscillatory function which first allows the tee to bend forward with the force of the bat strike and subsequently absorb the force energy by oscillating. The coil spring 156 is preferably chosen to have a tension which permits the tee under resting conditions to remain rigidly upright, and, prevent movement of the tee from its vertical orientation while the sled 116 is in reciprocal movement.

Turning now to the operation of motors 32 and 142 to effect operation of the movable tees 14 and 114, either motor 32,114 may be provided with features which vary the speed of movement of tee 14 toward the hitter. These features may include fast, medium or slow speeds, to accommodate different skill levels or ages, slow for youngster and fast for high school students, for example. Or, speed may be varied within a single movement; movement of tee 14,114 might start slowly and then be accelerated toward the end as the tee enters a strike zone. Also, operation of motors 32,142 might be done via provision of a control box hard wired to motor 32 or remotely controlled without wiring as exemplified by handset 144. These variations per se are well known to those of ordinary skill in the relevant arts and need not be detailed here.

It is envisioned that leagues of movable tee-ball players might be established; to that end, box 10,110 might be equipped with a carrying handle 170 (shown only in FIG. 3 with reference to the preferred embodiment) for displacement of the entire device away from home plate when a game is played. Furthermore, it is envisioned that the box portion could be buried in a permanent installation, with a trench dug to accommodate the movement of rod 12 or, probably more likely, with rod 12 reconfigured so as to move above the ground surface.

By now it is readily appreciated that the instant invention provides an entirely new meaning and definition to the art term "tee ball." The far more realistic presentation of ball to batter provided by a ball actually moving toward the batter and strike zone will greatly enhance training of the new ball player and provide a new horizon of practice for the seasoned player. The invention may be used to train players or be a part of tee ball play. The invention is uncomplicated in structure so that it may withstand use to the point of abuse, without malfunction.

It is to be understood that the present invention is not limited to the embodiments described above, but encompasses any and all embodiments within the scope of the following claims.

We claim:

1. A movable hitting tee for supporting a ball, comprising:

a vertically oriented support tee for supporting a ball a predetermined distance above a ground surface; and means for horizontally moving said support tee at a predetermined speed, and toward a preplanned strike zone for a hitter; whereby said movable hitting tee is a training and practice device which assists in training a hitter to keep an eye on the ball as it is moved toward the hitter by the tee, whereupon the hitter swings at the ball as the supported ball enters the preplanned strike zone.

2. The movable hitting tee according to claim 1, wherein said means for moving said support means toward a hitter comprises:

a box enclosure with opposed end walls;

a horizontally disposed drive and support rod extending outwardly from one said end wall and having an outer rod end, said support tee being mounted on said outer rod end;

slidably mounted carriage means within said box to which said drive rod is affixed, and movable to a first position with said rod full extended from said box, and retractable to a second position with said rod substantially retracted fully into said box, such that the support tee with ball is farthest from the hitter in said first position, the tee being moved to a strike zone where the hitter swings at the tee supported ball, in the second position.

3. The movable hitting tee according to claim 2, there further being motor means for effecting movement of said support tee toward and away from a hitter.

4. The movable hitting tee according to claim 1, there further being electric motor means for effecting movement of said support tee toward and away from a hitter.

5. The movable hitting tee according to claim 4, there further being battery means for powering said motor means.

6. The movable hitting tee according to claim 5, further comprising a remote controller for said electric motor means.

7. The movable hitting tee according to claim 1, wherein said support tee comprises a plurality of tubular sections, including at least one said telescopic tubular section and locking means for securing said telescopic tubular section in a fixed position.

8. The movable hitting tee according to claim 7, wherein said locking means is a lock ring.

9. The movable hitting tee according to claim 1, wherein said support tee includes a force dampening means permitting angular displacement of said support tee from a vertical position for minimizing the impact of a striking implement with said support tee.

10. The movable hitting tee according to claim 9, wherein said force dampening means is a coil spring.

11. The movable hitting tee according to claim 1, wherein said means for moving said support means toward a hitter comprises:

a box enclosure with opposed end walls;

a horizontally reciprocable sled comprising a support rod extending outwardly from one said end wall and having an outer rod end and an inner rod end, said support tee being mounted on said outer rod end and a drive plate being mounted on said inner rod end;

and means for mounting and reciprocally moving said sled relative to said box enclosure such that said sled is movable to a first position with said rod fully extended from said box, and retractable to a second position with said rod substantially retracted fully into said box, such that the support tee with ball is farthest from the hitter in said first position, the tee being moved to a strike zone where the hitter swings a bat at the tee supported ball, in the second position.

12. The movable hitting tee according to claim 11, further comprising a carrying handle attached to said box enclosure.

13. The movable hitting tee according to claim 11, wherein said means for mounting and reciprocally moving said sled includes a pair of sprockets and an endless chain, said sprockets rotatably disposed within said box, said endless chain revolvably engaged to said sprockets, and wherein said drive plate is attached to said chain, thereby moving said sled with and in the direction of said chain.

14. The movable hitting tee according to claim 11, there further being removable motor means for effecting movement of said support tee toward and away from a hitter.

15. The movable hitting tee according to claim 11, there further being electric motor means for effecting movement of said support tee toward and away from a hitter.

16. The movable hitting tee according to claim 15, there further being battery means for powering said motor means externally disposed to and removable from said box enclosure.

17. The movable hitting tee according to claim 16, further comprising a remote controller for said electric motor means having a removable battery as a power supply.

18. The movable hitting tee according to claim 11, wherein said support tee comprises a plurality of tubular sections, including at least one said telescopic tubular section and locking means for securing said telescopic tubular section in a fixed position.

19. The movable hitting tee according to claim 11, wherein said support tee includes a force dampening means permitting angular displacement of said support tee from a vertical position for minimizing the impact of a bat with said support tee.

20. The movable hitting tee according to claim 19, wherein said force dampening means is a coil spring.

* * * * *